US006382321B1

(12) United States Patent
Bates et al.

(10) Patent No.: US 6,382,321 B1
(45) Date of Patent: May 7, 2002

(54) DEWATERING NATURAL GAS-ASSISTED PUMP FOR NATURAL AND HYDROCARBON WELLS

(76) Inventors: Andrew Anderson Bates; Michael Lee Fraim, both of 2104 Mountain Oak Rd., Farmington, NM (US) 93311

( * ) Notice: Subject to any disclaimer, the term of this patent is extended or adjusted under 35 U.S.C. 154(b) by 0 days.

(21) Appl. No.: 09/653,358

(22) Filed: Aug. 31, 2000

Related U.S. Application Data

(60) Provisional application No. 60/153,697, filed on Sep. 14, 1999.

(51) Int. Cl.[7] ..... E21B 43/12

(52) U.S. Cl. ..... 166/372; 166/105; 417/172

(58) Field of Search ..... 166/372, 373, 166/370, 374, 105.5, 105.4, 105; 417/172, 179, 181

(56) References Cited

U.S. PATENT DOCUMENTS

| | | | | |
|---|---|---|---|---|
| 47,793 A | | 5/1865 | Brear | |
| 2,100,185 A | | 11/1937 | Engstrand | 103/267 |
| 2,909,127 A | | 10/1959 | Bradaska | 103/260 |
| 3,592,562 A | | 7/1971 | Spliethoff | 417/160 |
| 3,694,107 A | | 9/1972 | Stein | 417/167 |
| 3,857,651 A | | 12/1974 | Bruno | 417/171 |
| 4,028,009 A | | 6/1977 | Gudzenko et al. | 417/163 |
| 4,046,492 A | | 9/1977 | Inglis | 417/197 |
| 4,192,461 A | | 3/1980 | Arborg | 239/265.17 |
| 4,310,288 A | | 1/1982 | Erickson | 417/54 |
| 4,322,897 A | | 4/1982 | Brassfield | 37/62 |
| 4,332,529 A | | 6/1982 | Alperin | 417/54 |
| 4,372,712 A | | 2/1983 | Powell et al. | 406/153 |
| 4,448,354 A | | 5/1984 | Reznick et al. | 239/265 |
| 4,473,186 A | | 9/1984 | Alperin | 239/8 |
| 4,781,537 A | | 11/1988 | Nicodemus et al. | 417/54 |
| 4,815,942 A | | 3/1989 | Alperin et al. | 417/167 |
| 5,074,759 A | | 12/1991 | Cossairt | 417/198 |
| 5,080,560 A | | 1/1992 | LeRoy et al. | 417/172 |
| 5,282,359 A | | 2/1994 | Chester | 60/269 |
| 5,397,480 A | * | 3/1995 | Dickerson | 210/752 |
| 5,472,054 A | | 12/1995 | Hinds | 166/373 |
| 5,488,993 A | * | 2/1996 | Hershberger | 166/372 |
| 5,651,664 A | | 7/1997 | Hinds et al. | 417/172 |
| 5,667,364 A | | 9/1997 | O'Mara et al. | 417/151 |
| 5,806,599 A | * | 9/1998 | Hisaw | 166/372 |

FOREIGN PATENT DOCUMENTS

| | | |
|---|---|---|
| CH | 343582 | 2/1960 |
| IT | 425050 | 9/1947 |
| JP | 6-147199 | 5/1994 |
| PL | 42192 | 10/1958 |
| RU | 1244391 | 7/1986 |
| RU | 1352098 A | 11/1987 |

OTHER PUBLICATIONS

U.S. Ser. No. 60/153,697, filed Sep. 4, 2000, Bates et al.

* cited by examiner

*Primary Examiner*—Frank Tsay
(74) *Attorney, Agent, or Firm*—Staas & Halsey LLP

(57) ABSTRACT

A tool having a tube string made of inner and outer coaxial tubes, and a dewatering natural gas-assisted pump at the bottom of the tube string. The pump includes a nozzle, an eductor, and a diffuser. The nozzle has a central inlet and a number of primary angled gas outlets, each opening to a gas supply space between outer and inner pipes, and to the interior of the inner tube. These angled outlets allow the gas to accelerate, contributing to a venturi effect in the tool. A fluids/debris/etc. mixture moves from the nozzle ring to the inwardly inclined eductor, which causes the mixture to converge. Then, the mixture diverges along the outwardly inclined diffuser to the inner pipe in which the mixture moves to the surface. At the convergence/divergence area, the venturi effect is enhanced. That is, a number of secondary outlets, formed in the diffuser, introduces additional gas from the gas supply space to the interior of the inner tube.

24 Claims, 4 Drawing Sheets

40
41
42
43
44
45
46
47
48
49
30
31
A

DEWATERING NATURAL GAS-ASSISTED PUMP FOR NATURAL AND HYDROCARBON WELLS

CROSS REFERENCE TO RELATED APPLICATION

This application claims priority to provisional application Ser. No. 60/153,697, filed Sep. 14, 1999, and which is incorporated herein by reference.

BACKGROUND OF THE INVENTION

1. Field of the Invention

This invention relates to a tool for the removal of water from coal seam and/or coal bed methane wells, and the removal of hydrocarbon in oil/condensate wells, utilizing injected natural gas.

2. Description of the Related Art

Conventional tools, for removing such fluids from a well, usually inject natural gas as a "power fluid" along an outer pipe to exit at the bottom of the tool into an inner coaxial pipe. This creates, using a venturi effect, an upward gas stream in the inner pipe to facilitate flow of a water/debris/etc. mixture from the well. Examples of such conventional pumps follow.

U.S. Pat. No. 4,332,529 appears to show a primary and secondary entry points of fluid into the upward stream.

Italian Patent No. 425,050 appears to show an apparatus using compressed air for bringing water and mud to the surface. The apparatus has two, angled, compressed air outlets to the upward stream.

Polish Patent No. 42192 appears to show the introduction (and re-introduction) of fluid into a stream at successive points along the upward stream, via angled inlets a and c.

U.S. Pat. No. 4,815,942 appears to illustrate the introduction of fluid at a first inlet end via curved nozzles, and downstream therefrom.

U.S. Pat. No. 4,372,712 appears to show a fluid flow in a first tube, which is augmented by a secondary fluid flow downstream created by an inducer and an injector.

Russian Patent No. 1244391 appears to show a well ejection pump that uses two fluid fed nozzles at different elevations of the pump for improving pump output.

U.S. Pat. No. 2,100,185 similarly relates to a jet pump with dual steam inputs for producing a vacuum inside the pump.

U.S. Pat. No. 3,592,562 shows gasses that move from an outer tube into an inner tube at longitudinally different heights (jet passage and bore) relative to the bottom of the nozzle, one facing upstream and the other downstream.

U.S. Pat. No. 4,028,009 and Japanese Reference No. 6-147,199 similarly appears to show a tube having sets of longitudinally spaced angled ports.

Russian Patent No. 1352098 appears to show first upstream rotating nozzles, and a relatively downstream entry point at an active nozzle for introduction of fluid moving along an outer tube and into the inner tube.

U.S. Pat. No. 4,473,186 relates to an annular primary injector, an ejector with a converging inlet section and a diverging diffuser section.

U.S. Pat. No. 4,310,288 shows a set of circularly spaced, tangentially disposed nozzles which allow fluid to enter an inner tube fluid flow from an outer tube, and secondary outlets.

U.S. Pat. No. 4,781,537 illustrates the use of primary and secondary fluid inputs for an injector.

U.S. Pat. No. 3,857,651 relates to a multi-member tube, wherein each has a ring with angled inlets.

This prior art, however, still does not disclose or teach a fluid extracting pump including, in combination, inner and outer coaxial tubes, primary angled gas outlets near to a pump central inlet, convergence and divergence of the fluid pate and/or a plurality of secondary gas outlets upstream the central inlet for introduction of additional gas, which enhance the venturi effect, provide atomization, create a fluid envelope to prevent sticking, and prevent debris fall back.

SUMMARY OF THE INVENTION

Accordingly, it is a purpose of the present invention to provide a more efficient pump for removing a fluid/debris/etc. mixture from a natural gas or hydrocarbon well, It is another object of the present invention to provide a dewatering tool that includes no moving parts, thereby extending the useful life of the tool.

It is another object of the present invention to provide a dewatering tool that allows chemicals to be added to the power gas to promote longer run times for the well.

It is still another object of the present invention to provide a dewatering pump which can operate in fluid levels lower than the height of the pump.

It is a further object of the present invention to provide a power fluid assisted dewatering tool, wherein the flow of the power fluid can be regulated remotely of the tool.

It is another purpose of the present invention to provide a tool using both primary and secondary power gas outlets for a pump to facilitate upward movement of a fluid stream.

It is a further purpose of the present invention to provide a well dewatering tool including a plurality of secondary gas outlets for introduction of additional gas into the venturi area downstream from a set of primary gas outlets, resulting in atomization, a fluid envelope and debris fall back prevention.

Further, it is an object of the present invention to provide a dewatering tool having a pump with successive converging and diverging surfaces, and a supplemental introduction of power fluid at the intersection of the converging and diverging surfaces, to enhance a venturi effect of the pump.

To achieve the foregoing and other purposes of the present invention, there is provided a tool with a dewatering natural gas-assisted pump including a nozzle at a central inlet of the tool. The nozzle has a number of primary angled gas outlets, each with a first end opening to a space formed between outer and inner tubes of a pipe string, and the other end opening to the interior of the inner tube. These angled primary outlets allow the gas to accelerate, contributing to the venturi effect. The fluids/debris/etc. mixture moves from the nozzle to an eductor having an inwardly (relative to a tool central axis) inclined interior surface, which causes the mixture to converge. Then, via a diffuser, the mixture diverges along an outwardly inclined interior surface thereof to the inner tube, in which the mixture moves to the surface. As the mixture is leaving the eductor, however, it is further accelerated, i.e., the venturi enhanced, by secondary angled gas outlets formed in the diffuser which introduce additional gas from the space, between the diffuser and eductor, and into the interior of the inner tube, downstream of the primary outlets. When this gas is introduced at the secondary outlets, the mixture is also effectively atomized to facilitate movement of the mixture up the tool. The injected gas also serves to form a type of fluid envelope around the ascending mixture, which helps prevent the mixture from sticking to the inner tube. Also, by introducing additional gas above the central inlet, and downstream from the primary gas outlets, debris is less likely to fall back down the tool.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

The preferred embodiments of the present invention will now be described with reference to FIGS. 1–11. In this description, certain dimensions are used to assist in understanding the structure of the invention. Of course, one of ordinary skill, may use different-sized tube strings, and vary the dimensions of the pump components accordingly. As a result, it is not intended that the invention be limited by any particular dimensions.

Tool Generally

Figure 1:
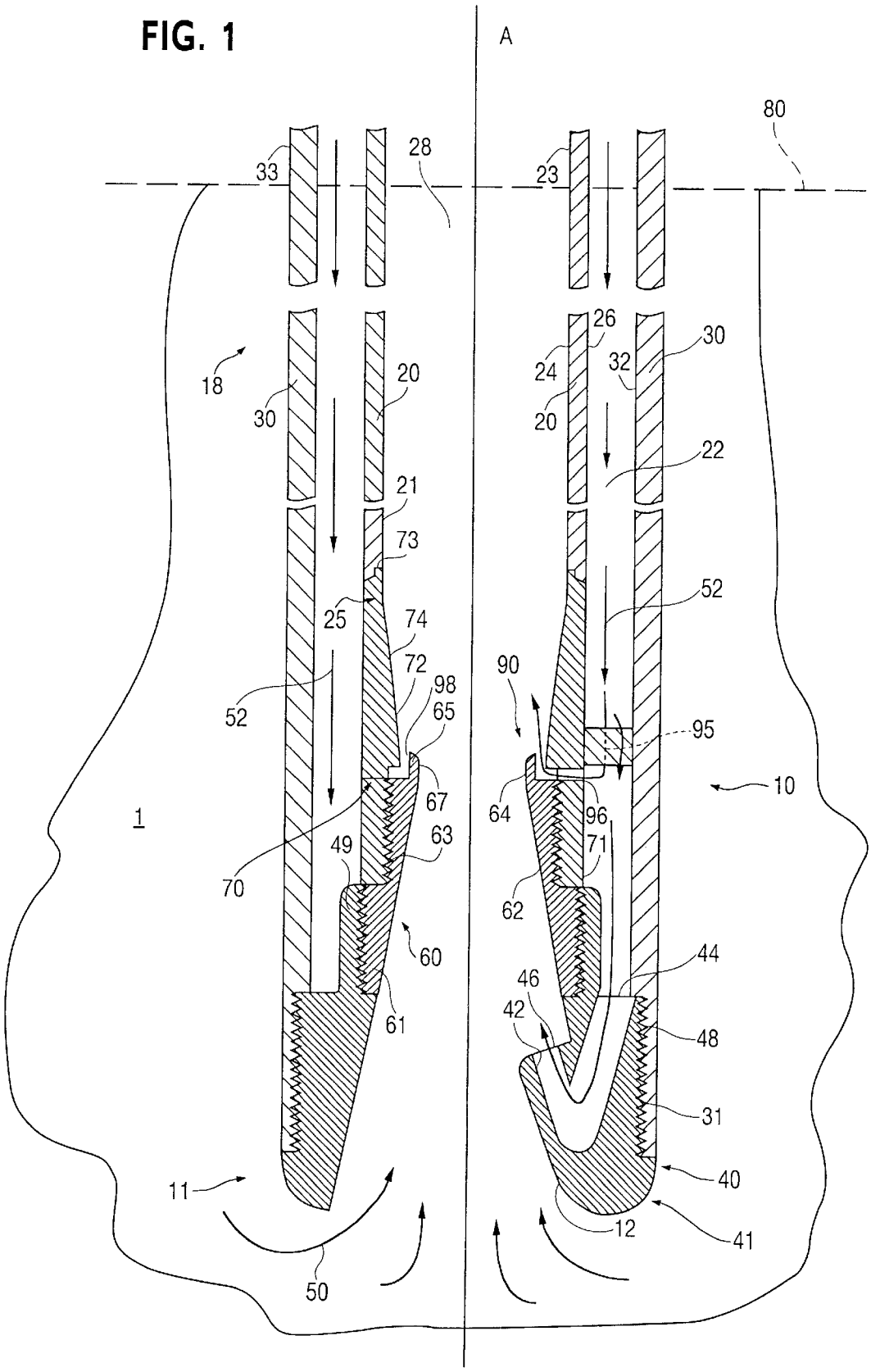
FIG. 1 is a side, cross-sectional view of the tool according to the present invention.

The invention is a dewatering/hydrocarbon natural gas-assisted below surface well tool. FIG. 1 is a side, cross-sectional view of the tool indicated by reference numeral 1. The tool 1 includes generally a jet pump 10, and a tubing string 18 having an axis A, an inner tube 20, and a coaxial outer tube 30.

Pump Generally

The pump 10, as best shown in FIG. 1, includes a nozzle ring 40, an eductor ring 60 and a diffuser ring 70 which are connected by corresponding threaded abutting surfaces. A mixture 50 of fluids (gas, liquids in the form of water, oil, or condensate along with debris from hydraulic fracture treatments, i.e., FRAC sand and formation lithology) is moved upwardly through an interior 28 of the tool 1 via the pump 10.

The nozzle ring 40 is located at a bottom 11 of the tool 1, and forms a central inlet 12 of the tool 1. The central inlet 12 is preferably about a 1.5" opening. The nozzle ring 40 has a number of primary angled gas outlets 42, each extending from an annular space 22 formed between the outer 30 and inner tubes 20, to the interior 28 of the tool 1. These angled outlets 42 cause the gas to accelerate, thereby contributing to the venturi effect, as described below.

The pump 10 also includes, adjacent the nozzle ring 40, an eductor ring 60, which causes the mixture 50 to converge. Then, at a diffuser ring 70, the mixture 50 diverges to the inner tube 20, through which the mixture 50 moves to the surface 80. It is at this convergence/divergence area that an venturi effect occurs.

That is, as the mixture 50 leaves the eductor ring 60, it is accelerated by additional gas 52 being emitted from a number of secondary angled outlets 90 in the diffuser 70, also extending from the space 22 to the interior 28 of the inner tube 20. This additional gas effectively atomizes the mixture 50 to facilitate movement thereof up the tool 1. The injected gas 52 also serves to form a type of fluid envelope, with the diffuser 70, around the ascending mixture 50, which helps to prevent the mixture 50 from sticking to the inner wall 24 of the inner pipe 20. Also, by introducing gas above the bottom central inlet. 12 of the tool 1, and above the primary outlets 42, debris is less likely to fall back down the tool.

The above-introduced components of the tool 1 are described more fully below.

Tube Strings

The outer tube 30 is preferably about a 3½" outer diameter, and about a 2¾" inner diameter. A coaxial approximately 2¹⁄₁₆" OD and approximately 1¾" ID inner tube 20 is used for recovery of the water/oil/condensate and formation fines or any wellbore debris during the dewatering. The inner tube 20 assembly has a first end 21 sealingly attached to the pump 10 via a sealable receptacle 25, and a second end 23 at the surface 80 of the earth. The outer tube 30 similarly has a first end 31 sealingly attached to the pump 10 and a second end 33 at the surface 80 via a tubing hanger.

The natural gas power fluid 52 is injected at the surface 80 into the annular space 22 between an outer wall 26 of the inner tube 20 and an inner wall 32 of the outer tube 30, toward the bottom hole dewatering pump 10.

Nozzle

Figures 2, 3, 4:
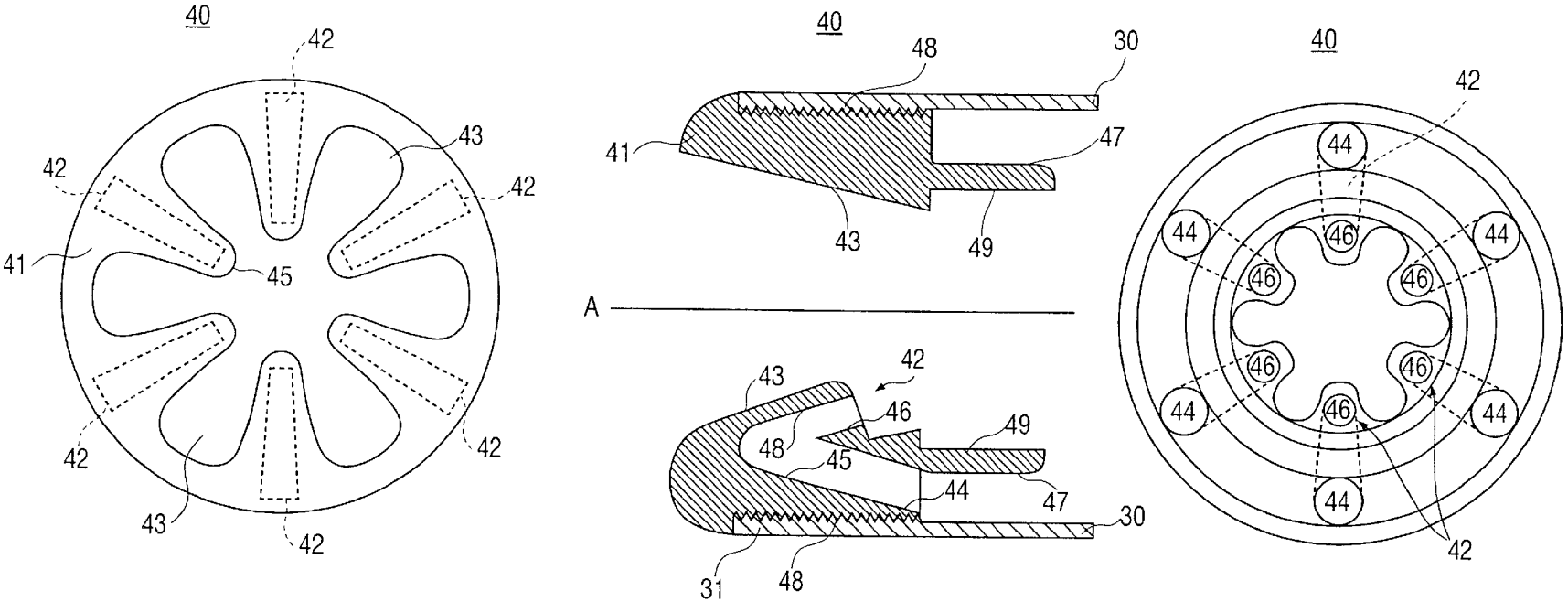
FIG. 2 is a front view of the nozzle ring.
FIG. 3 is a side, cross-sectional view of the nozzle ring and outer tube.
FIG. 4 is a rear view of the nozzle ring.

FIG. 2 is a front view of the nozzle ring 40, FIG. 3 is a side, cross-sectional view of the nozzle ring, and FIG. 4 illustrates a rear thereof.

The nozzle ring 40 preferably has an outside diameter of about 3½", and includes a rounded nose 41 and interior walls 43 that taper inwardly at about 11 degrees relative to the axis A, to about a 1" opening. At the end opposite the nose 41, there is formed a cylindrical extension 47, an interior wall 49 of which receives the eductor 60, as described below. An outer wall 48 of the nozzle 40 receives in complementary fashion the first end 31 of the outer tube 30.

The nozzle ring 40 includes, e.g., four to eight of the primary gas outlets 42, but six outlets 42 spaced about 1.5" apart, as shown in FIG. 2, is preferable. Each outlet 42 includes a first end 44 opening to the space 22, and a second opposite end 46 opening to the interior 28 of the tool 1. Opposing ends 46 of the outlets 42 are spaced about 0.8" diametrically from each other. A first channel 45 is about ⁵⁄₁₆" in diameter and is angled about 13 degrees relative to axis A, and a second continuous channel 48 is about ³⁄₁₆" diameter and is angled relative to the first channel 45, forming an elbow, but preferably there are no sharp edges in the primary outlets 42. The second channel 48 is angled relative to the axis A in the range of about 15–25 degrees, and preferably 20 degrees,. The purpose of this angle is to allow the natural gas (power fluid) to accelerate out of the outlet 42, contributing to the venturi effect, pulling gas, water, oil, condensate, geologic formation fines along the eductor ring 60, and transporting them toward the surface 80, as shown in FIG. 1.

The second channel 48 is tapered to about 5 degrees to prevent underexpansion of the power gas 52 and increase the venturi effect of the pump 10. This structure is different from the prior art of straight liquid power fluid nozzles because liquids do not expand significantly before mixing with the intake fluids. Experiments have shown that if the power gas has not fully expanded when it leaves the nozzle 40, it will choke the intake due to perpendicular expansion of the power gas stream as it compresses in the educator ring 60. Choking the intake will reduce the pump 10 efficiency and reduce the maximum operating pressure drop.

Each cylindrical channel creates a vortex in the educator ring 60. As the vortex is compressed in the educator ring 60, it increases the shearing and spinning. By using multiple individual cylindrical channels in the nozzle ring 40, the individual vortexes shear against each other as they are compressed in the educator ring 60. These multiple shearing layers maximize the atomization of the pumped fluid and break up of solid matter.

Eductor Ring

Figure 7:
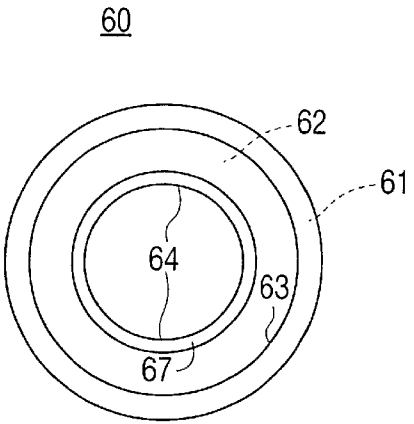
FIG. 7 is a rear view of the eductor ring.
Figure 6:
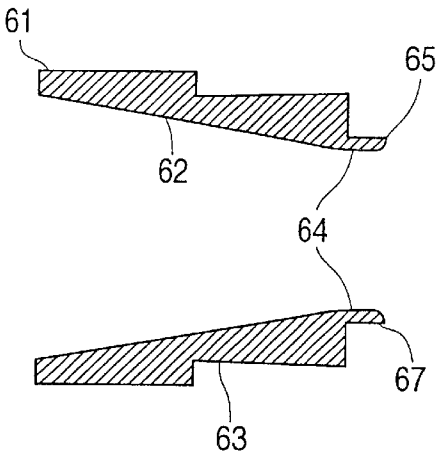
FIG. 6 is a side, cross-sectional view of the eductor ring taken along line 6—6 in FIG. 5.
Figure 5:
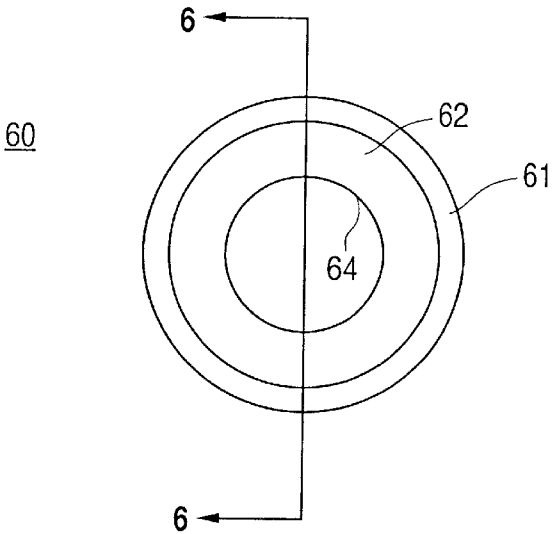
FIG. 5 is a front view of the eductor ring.

FIG. 5 illustrates the front of the eductor ring 60, FIG. 6 a side, cross-sectional view, and FIG. 7 a rear view.

The eductor ring 60, as shown in FIGS. 1 and 5–7, is generally cylindrical, with a first end 61 which is about 1½" wide, and which is received in the cylindrical extension 49 of the nozzle ring 40, as shown particularly in FIG. 3. In the middle of the eductor ring 60, there is formed an outer wall 63 which receives the diffuser 70, as noted below. At a second, opposite end 65 of the eductor ring 60 there is formed a cylindrical extension 67.

The eductor ring 60 includes an interior surface 62 between the first end 61 and the cylindrical extension 67, with about an 11 degree inward angle which causes the mixture to converge to about a 0.8" diameter at an eductor ring throat 64. The angle allows for fluid acceleration from the approximately 1.5" opening at the first end 61 down to the about 0.8" at the throat 64 of the eductor 60.

Diffuser Ring

Figure 10:
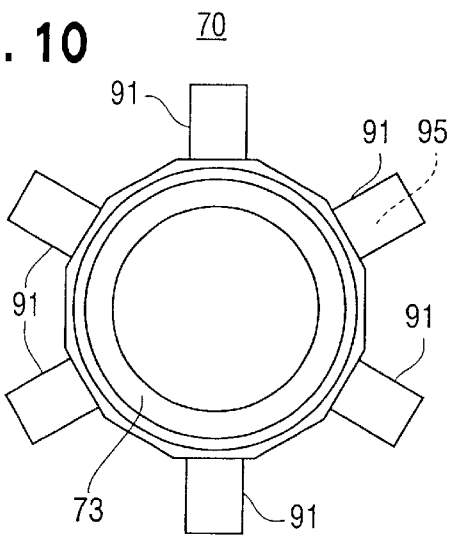
FIG. 10 is a rear view of the diffuser ring.
Figure 9:
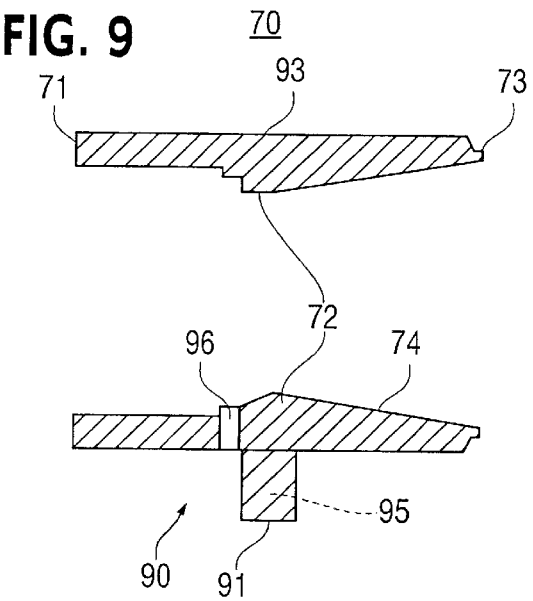
FIG. 9 is a side, cross-sectional view of the diffuser ring, taken along line 9—9 in FIG. 8.
Figure 8:
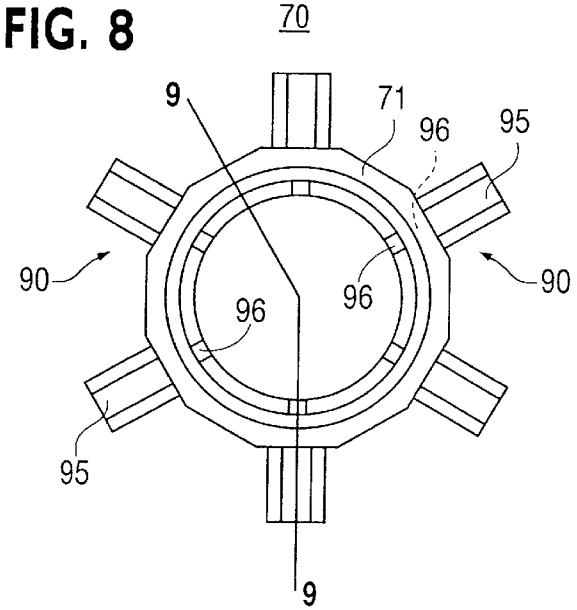
FIG. 8 is a front view of the diffuser ring.

FIG. 8 shows the front of the diffuser ring 70, FIG. 9 a side, cross-section, and FIG. 10 a rear view.

The diffuser ring 70 includes a first end 71 which is received by the outer wall 63 of the eductor ring 60. The diffuser ring 70 also includes a second receptacle end 73 which sealably receives the first end 21 of the inner tube 20. In a middle portion 93 of the diffuser ring 70 there is formed the plurality of secondary gas outlets 90. Four to eight secondary outlets 90, for example, could be used, but in the preferred embodiment, six outlets 90 are used, as shown in FIGS. 8–11, spaced about 1.5" apart.

More particularly, the plurality of secondary outlets 90 is located in the pump 10 downstream of the plurality of primary outlets 42, and extends from the space 22 to the interior 28 of the inner tube 20. Each of the plurality of secondary outlets 90 includes about a ⅛" first port 96. Between the cylindrical extension 67 of the eductor ring 60, and the first port 96, there is formed a second port 98 which is about ⅛, and is continuous with but perpendicular to the first port 96. The plurality of secondary outlets 90 introduces gas from the space 22, into the fluid 50 moving in the first direction, i.e., downstream, in the interior 28 of the inner tube 20, just after the moving fluid converges at the throat 64.

This structure further enhances the venturi effect based on the velocity of the gas 52 injected between the eductor ring 60 and the diffuser ring 70. This re-injection of gas 52 also allows for less debris to fall back down inside the tool 1, thereby avoiding plugging the inner tube 20, and causes an envelope to form around the mixture to prevent sticking of mixture 50 components on the inner tube 20, as described more fully below.

After the re-injected gas 52 and fluid mixture 50 combine near the second end 65 of the eductor ring 60, the opening increases from about 0.8" to about 1½, as described below, to facilitate entry into the inner tube 20.

Figure 11:
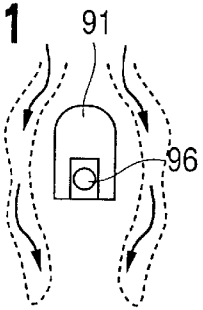
FIG. 11 is a schematic view of the gas flow around a portion of the diffuser ring.

In field operations, the power fluid 52 injected into the space 22 is not completely clean. To prevent entrained rust, pipe dope, compression oil, etc. from plugging the secondary outlets 90, extensions 91 are used, having a bluff body shape, to create a standing vortex at ports 96. The vortex spins the heavier materials back into the gas 52 flow stream, as shown in FIG. 11, which move down to the larger primary outlets 42. This allows the pump 10 to have a longer service life. The clean gas 52 otherwise enters recesses 95 on the undersides of the extensions 91 and into the first ports 96, and then into the second ports 98, and finally into the main flow stream upward.

The combined fluids/debris is aided in acceleration through the pump 10 with the addition of about a 1.2" internal diameter throat 72 of the diffuser ring behind the approximately 0.8" convergence at the throat 64 of the eductor ring 60. The mixture 50 then diverges along a surface 74 having a 7–8 degree taper relative to the axis A to about 1 ½" internal diameter prior to entrance into the inner tube 20.

The diffuser ring 70 structure atomizes the mixture 50 into a Brownian motion state in the gas 52, and adds additional acceleration due to the divergence. The atomized fluid flows up the inner tube 20 in an atomized flow state, which prevents liquid from getting caught up in the tubing and logging off the gas well. The atomized flow state also minimizes the flowing bottom hole pressure. This action also places an envelope of gases around the accelerated combined fluids, i.e., the re-injected gases, formation gas, oil, condensate, water, and debris mixture 50.

This diffuser ring 70 structure is especially useful in inhibiting film flow whereby the more dense fluids (water, oil, condensate, debris) have a tendency to adhere to the inner wall 24 of the inner tube 20 and the less dense fluids (injected gas 52) have the tendency to flow up the center portion (along axis A shown in FIG. 3) of the inner tube 20. Combining the fluids and placing them into an atomized state reduces the hydrostatic column of the transported fluids up the inner tube 20 and inhibits paraffin crystallization on the inner wall 24 of the inner tube 20.

Operation

For dewatering or removal of oil/water/condensate through artificial lift utilizing natural gas as the re-injection power fluid, the tool 1 is run in the oil/gas wellbore on the bottom of the outer tube 30. The tool 1 is set with a thread compatible with the existing or replacement tubing that is going to be used in the wellbore. The outer tube 30 is landed in a conventional way utilizing an industry/API approved method by way of a tubing hanger. An upper tree is installed on the tubing head and an additional smaller tubing head is screwed or bolted onto an upper tree master valve. The existing workover or completion unit is removed, depending upon the inner tubing string side, and a coil-tubing unit is brought in to run the tool's seal assembly on the end of the coil tubing used as the inner tube 20. The coil-tubing unit is rigged with a pack-off tubing hanger and is slid onto the coil tubing so as not to allow fluids to flow during installation of the inner tube 20.

A seal assembly housing is made 15–20 thousandths of an inch over the outside diameter of the inner tube 20 with dual O rings (not shown) so as to be affixed to the end of the coil tubing with set screws (not shown). These set screws are used to fix the seal assembly to the outside of the coil tubing, and they have the ability to shear off in the event debris falls around the seal bore housing, allowing easier recovery of the inner coil tubing string and conventional oilfield practice for removal and installation of the outer production tubing string. The seal assembly is run into the wellbore through the outer tube 30 and seated into a seal bore receptacle. Slips are placed alongside and above the coil-tubing pack off hanger so as not to let the inner tube 20 move during operation. The inner tube 20 is cut-off above the slips approximately 1 foot, and a swedge is installed along with a full ported ball valve which allows the ability to shut-off fluid flow up the inner tube 20. The coil-tubing unit is rigged down. The well is ready for production.

The casing valve and tubing valves are manifolded together or separate depending on what type of surface equipment is on the well, and the gas re-injection compressor and/or sales compressor line is diverted with a tee to allow a portion of the gas to be re-injected and/or a majority of the gas to be sold. The re-injected gas 52 is injected down the annular space 22 between the inner tube 20 and the outer tube 30. The gas 52 enters the pump 12 through the primary outlets 42 of the nozzle ring 40, accelerating the combined fluids (the re-injected gas and the formation fluids of natural gas, oil, condensate, water, and debris particles) mixture 50 past the eductor ring 60 and into the inner tube 20 for production and recovery of these fluids. The diffuser ring 70 takes a percentage of the gas 52 and introduces same through the secondary outlets 90 to place an envelope around the outside of the combined fluids and turning them into a vapor state so that the fluids are returned to the surface 80 as a vapor rather than as separate liquids and gas.

A high volume natural gas compressor/booster system (not shown) is employed. The tubing 20, 30 uses a seal assembly (not shown) at the seal bore receptacle (not shown) above the eductor ring 60. A pressure gauge (not shown) is placed in the space 22 and measurements are taken in relation to volume through the pump 10 and what back pressure ensues at the nozzle ring 40. For example, one hundred psi equals 750,000 standard cubic feet of natural gas per day through the pump, with 0 psi pressure at the nozzle ring, and continued up to 1,000,000 standard cubic feet of natural gas per day with 0 psi pressure at the nozzle ring 40, which is the intake of the pump 10. At 200 psi, which equaled 1,500,000 standard cubic feet of natural gas per day, a slight blow may ensue at the bottom of the pump of 5–10 psi. Tests of 250,000 and 500,000 standard cubic feet of natural gas per day where performed and items where placed into the entry of the pump, i.e., dirt balls and pens and all where sucked through and/or vaporized, in a very fine particulate state, as they exited the pump 10. A standing valve was attached to the bottom of the pump 10 to help ensure fluid recoveries up the inner tube string 20 to the surface 80.

The invention is also characterized by the following additional benefits.

Having no moving parts aids in the life expectancy of the tool 1. Chemicals for paraffin and scale can be added to the re-injected gas 52 to aid in a longer production run time for the well. Conventional artificial lift methods, i.e., pumping units or progressive cavity pumps, require a height of fluid above a fluid pump so as not to gas lock and/or burn up due to friction. On the other hand, the pump 10 of the present invention has the ability to recover all the fluids that enter into the wellbore. For environmental profile aesthetics, the total height of the wellhead is less than existing production separation equipment. With new and improved cellular connections, change of re-injection volumes can be performed from remote offices, such as corporate offices.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A tool for dewatering a well, comprising:

a first elongated, hollow tube having a first end, a second end, and a longitudinal axis, a second elongated hollow tube having a first end and a second end, being coaxial with and internal of the first tube, and including an interior in which fluid moves, a space formed between the first and second tubes through which gas moves in a first direction from the second end to the first end, a pump having a first end, a second end and a middle portion, and including a nozzle at the first end, an eductor at the middle portion and a diffuser at the second end, said pump being arranged at the first ends of the first and second tubes, said pump also including a central inlet for allowing fluid external of the tool to move into the central inlet and into the interior of the second tube along a second, opposite direction, said nozzle including a plurality of primary outlets extending from the space to the interior of the second tube for introducing gas moving in the space in the first direction into the fluid moving in the second direction, said eductor including a converging portion, said diffuser including a diverging portion, and a plurality of secondary outlets, located in the pump downstream of the plurality of primary,outlets, and extending from the space to the interior of the second tube, said plurality of secondary outlets introducing gas moving in the first direction into the fluid moving in the second direction in the interior of the second tube.

2. The tool as recited in claim 1, wherein the plurality of secondary outlets is located between the educator and the diffuser.

3. The tool as recited in claim 2, wherein the number of the plurality of primary outlets is five to seven.

4. The tool as recited in claim 2, wherein each of the plurality of secondary outlets includes a first portion formed in the diffuser to extend from the space perpendicular to the axis, and a second portion formed between the diffuser and the educator that is continuous with the first portion and which is oriented perpendicular to the first portion to open in a downstream direction.

5. The tool as recited in claim 4, wherein the number of the plurality of secondary outlets is six.

6. The tool as recited in claim 1, wherein each of the plurality of primary outlets includes a first portion extending from the space in a generally upstream direction, and includes a second portion continuous with the first portion and extending generally downstream at an angle of about 20 degrees relative to the first portion.

7. The tool as recited in claim 1, wherein the converging portion of the educator is angled at about 11 degrees relative to the axis.

8. The tool as recited in claim 1, wherein the diverging portion of the diffuser is angled at about 7–8 degrees relative to the axis.

9. The tool is recited in claim 1, wherein each of the primary outlets is a pair of channels angled relative to each other in the range of about 15–25 degrees.

10. A tool for dewatering a well, comprising:

a first elongated, hollow tube having a first end, a second end, and a longitudinal axis, a second elongated hollow tube having a first end and a second end, being coaxial with and internal of the first tube, and including an interior in which fluid moves, a space formed between the first and second tubes through which gas moves in a first direction from the second end to the first end, a pump having a first end, a second end and a middle portion, and including a nozzle at the first end, an eductor at the middle portion and a diffuser at the second end, said pump being arranged at the first ends of the first and second tubes, said pump also including a central inlet for allowing fluid external of the tool to move into the central inlet, through the pump, and into the interior of the second tube along a second, opposite direction, said nozzle including a plurality of primary outlets extending from the space to the interior of the second tube for introducing gas moving in the space in the first direction into the fluid moving in the second direction, wherein each of the plurality of primary nozzle outlets includes a first portion extending from the space in a generally upstream direction, and includes a second portion continuous with the first portion and extending generally downstream at an angle of about 20 degrees relative to the first portion, said eductor including a portion converging toward the axis in the second direction, said diffuser including a portion diverging from the axis in the second direction, and a plurality of secondary outlets, located in the pump downstream of the plurality of primary outlets, and extending from the space to the interior of the second tube, said plurality of secondary outlets introducing fluid moving in the first direction into the fluid moving in the second direction in the interior of the first tube, wherein each of the plurality of secondary outlets includes a first portion formed in the diffuser to extend from the space perpendicular to the axis, and a second portion formed between the diffuser and the eductor that is continuous with the first portion and which is oriented perpendicular to the first portion to open in a downstream direction.

11. The tool as recited in claim 10, wherein the number of the plurality of primary outlets is six.

12. The tool as recited in claim 11, wherein the number of the plurality of secondary outlets is six.

13. The tool as recited in claim 12, wherein the converging portion of the educator is angled at about 11 degrees relative to the axis.

14. The tool as recited in claim 13, wherein the diverging portion of the diffuser is angled at about 7–8 degrees relative to the axis.

15. The tool as recited in claim 10, wherein each of the primary outlets is a pair of channels angled relative to each other in the range of about 15–25 degrees.

16. A tool for dewatering a well, comprising:

a first elongated, hollow tube having a first end, a second end, and a longitudinal axis, a second elongated hollow tube having a first end and a second end, being coaxial with and internal of the first tube, and including a cylindrical interior with a first internal diameter in which fluid moves, a space formed between the first and second tubes through which gas moves in a first direction toward the first end of the first tube, a pump having a first end, a second end and a middle portion, and including a nozzle at the first end, an eductor at the middle portion and a diffuser at the second end, said pump being arranged at the first ends of the first and second tubes, and said pump also including a central inlet for allowing fluid external of the tool to move into the central inlet and into the interior of the second tube along a second, opposite direction, said nozzle including a plurality of primary outlets extending from the space to the interior of the second tube for introducing the gas moving in the space in the first direction into the fluid moving in the second direction, said eductor including a converging portion forming a circular opening with a second diameter larger than the first diameter, wherein the converging portion of the eductor is angled at about 11 degrees relative to the axis, said diffuser including a diverging portion forming a circular opening with a diameter smaller than the second diameter of the eductor, but at least equal to the first diameter, wherein the diverging portion of the diffuser is angled at about 7–8 degrees relative to the axis, and a plurality of secondary outlets, located in the pump downstream of the plurality of primary outlets, and extending from the space to the interior of the second tube, said plurality of secondary outlets introducing gas moving in the first direction into the fluid moving in the second direction in the interior of the secondary tube.

17. The tool as recited in claim 16, wherein the plurality of secondary outlets is located between the educator and the diffuser.

18. The tool as recited in claim 16, wherein each of the plurality of primary outlets includes a first portion extending from the space in a generally upstream direction, and includes a second portion continuous with the first portion and extending generally downstream at an angle of about 20 degrees relative to the first portion.

19. The tool as recited in claim 16, wherein each of the plurality of secondary outlets includes a first portion formed in the diffuser to extend from the space perpendicular to the axis, and a second portion formed between the diffuser and the educator that is continuous with the first portion and which is oriented perpendicular to the first portion to open in a downstream direction.

20. A method for dewatering a well, comprising the step of:

(a) introducing a fluid into an opening at a first end of a tool to allow the fluid to flow within an interior of the tool from a first end of the tool to a second end of the tool;

(b) introducing a gas into the fluid flow immediately downstream of where the fluid flow is introduced;

(c) converging the fluid flow in the tool;

(d) introducing the gas into the fluid flow immediately downstream of where the fluid flow is converged; and (e) diverging the fluid flow in the tool.

21. The method as recited in claim 20, wherein the first introducing step includes the step of angling the gas downstream into the fluid flow.

22. The method as recited in claim 20, wherein the first introducing step includes the step of introducing the gas at a plurality of substantially co-planar locations.

23. The method as recited in claim 20, wherein the second introducing step includes the step of introducing the gas at a plurality of substantially co-planar locations.

24. A method for dewatering a well, comprising the steps of:

(a) introducing a fluid into an opening at a first end of a tool to allow the fluid to flow within an interior of the tool from a first end of the tool to a second end of the tool;

(b) introducing a gas in angled relation to the fluid flow, and at a plurality of substantially co-planar locations, immediately downstream of where the fluid flow is (c) converging the fluid flow in the tool;

(d) introducing the gas to the fluid flow, and at a plurality of locations, immediately downstream of where the fluid flow is converged;

(e) diverging the fluid flow in the tool;

(f) remotely changing the amount of gas introduced in at least one of steps (b) and (d).

* * * * *

UNITED STATES PATENT AND TRADEMARK OFFICE

CERTIFICATE OF CORRECTION

PATENT NO. : 6,382,321 B1
DATED : May 7, 2002
INVENTOR(S) : Andrew A. Bates et al.

It is certified that error appears in the above-identified patent and that said Letters Patent is hereby corrected as shown below:

Column 8,
Line 66, change “educator” to -- eductor --;

Column 9,
Line 57, change “educator” to -- eductor --;

Column 10,
Lines 43 and 55, change “educator” to -- eductor --;

Column 12,
Line 7, after “flow is” insert -- introduced; --.

Signed and Sealed this

Fifth Day of November, 2002

*Attest:*

*Attesting Officer*

JAMES E. ROGAN
*Director of the United States Patent and Trademark Office*